US008281412B2

(12) United States Patent
Byrnes

(10) Patent No.: US 8,281,412 B2
(45) Date of Patent: Oct. 9, 2012

(54) MULTI-PIECE ARTICLE OF CLOTHING

(75) Inventor: Lauretta Anne Byrnes, Setauket, NY (US)

(73) Assignee: L. A. Byrnes Enterprises, Inc., Setauket, NY (US)

( * ) Notice: Subject to any disclaimer, the term of this patent is extended or adjusted under 35 U.S.C. 154(b) by 111 days.

(21) Appl. No.: 13/010,405

(22) Filed: Jan. 20, 2011

(65) Prior Publication Data

US 2012/0185992 A1 Jul. 26, 2012

(51) Int. Cl.
*A41D 7/00* (2006.01)

(52) U.S. Cl. ..... 2/67; 2/409; 2/240; 450/95

(58) Field of Classification Search ..... 2/67, 61, 2/409, 239, 240, 70, 133; 450/100, 113, 450/95, 28; D2/736, 737, 700, 703, 714, D2/731

See application file for complete search history.

(56) References Cited

U.S. PATENT DOCUMENTS 3,106,717 A 10/1963 Cuvin
3,392,730 A * 7/1968 Relli ..... 450/30
3,547,128 A * 12/1970 Keltner ..... 450/95
3,556,107 A 1/1971 Brumfield
3,877,078 A 4/1975 Tepper
3,997,982 A 12/1976 Holland
4,019,208 A * 4/1977 Walser et al. ..... 2/240
5,184,351 A 2/1993 Benstock
6,185,741 B1 2/2001 Kehoe
6,830,566 B2 12/2004 Kuen et al.
7,260,852 B2 8/2007 Sheetz
2002/0111596 A1 8/2002 Fletcher et al.
2002/0174475 A1 11/2002 Mayr
2004/0128733 A1 7/2004 Hendricks
2009/0126072 A1 5/2009 Allen
2009/0204088 A1 8/2009 Stearman et al.

* cited by examiner

*Primary Examiner* — Alissa Tompkins
(74) *Attorney, Agent, or Firm* — Scully, Scott, Murphy & Presser, P.C.

(57) ABSTRACT

A multi-piece article of clothing, and a method of manufacturing the same, includes a plurality of pieces of clothing. Each of the plurality of pieces of clothing includes a top strap and a bottom leg portion being substantially opposite one another for engaging with an opposite shoulder and leg of a person, respectively. Each of the plurality of pieces of clothing includes a body portion, and each of the body portions includes a crotch portion. Each of the body portions include one leg opening and one hip opening defined by the crotch portions and respective side sections. The body portion of each of the plurality of pieces of clothing is in overlapping relation with each other to at least partially cover the person.

18 Claims, 4 Drawing Sheets

Fig. 4
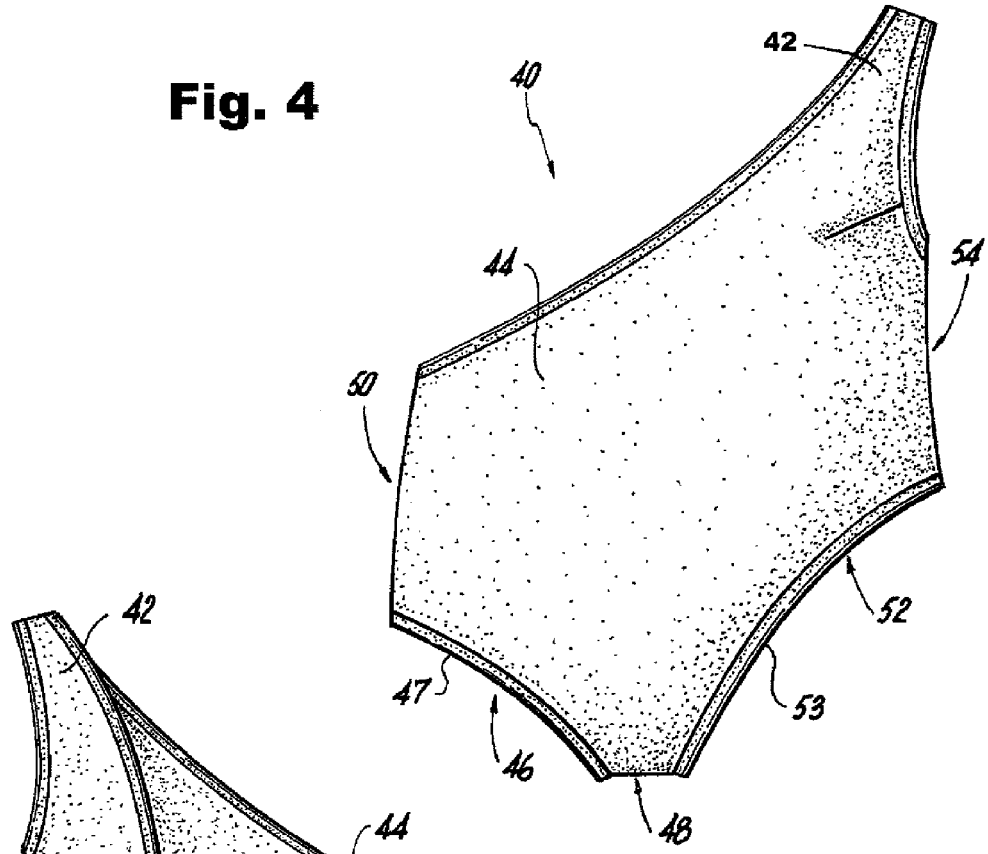
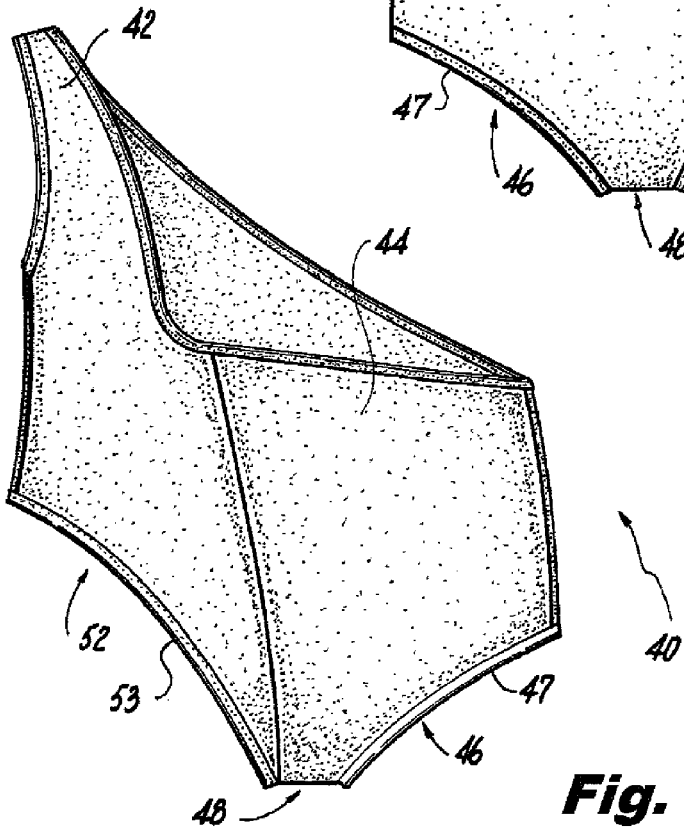
Fig. 5

MULTI-PIECE ARTICLE OF CLOTHING

BACKGROUND OF THE INVENTION

1. Field of the Invention

The present invention relates to a multi-piece article of clothing and a method of construction of the multi-piece article of clothing, and more particularly, relates to an overlapping multi-piece article of clothing for a person and a method of construction of the same.

2. Description of Related Art

Known in the art are articles of clothing that overlap to cover the torso, or are reversible, having straps, clasps, fasteners, and ties. Additionally, known are multi-piece articles of clothing such as bikini or tankini swimsuits which cover or leave exposed specific areas of a person. Also known in the art are articles of clothing that can be accessorized with additional pieces of clothing and size adjustments. For example, a known attachable/detachable swimwear garment includes a bottom garment piece attached to a top garment piece. Another known swimwear article includes at least one detachable panel, and another garment includes a convertible swimsuit. In another example, a pant-like absorbent garment includes removable side panels. Although known articles of clothing may address ease of dressing for a disabled or physically challenged person, the clothing typically requires the help of another person in addition to the person being clothed. For example, clothing is available which requires another person, other than the person being clothed, to attach fasteners at the back of the garment, or to open and close side zippers. In another example, a one-piece swimsuit for elderly or disabled persons requires overlapping flaps of fabric which are attached using hook and loop fasteners which require adequate dexterity and flexibility of the person clothing themselves. Therefore, one disadvantage in the art, for example, is a lack of a swimsuit which can be easily worn and put on and taken off that provides the coverage and stability of a one-piece suit. Thus, people may be deterred from participating in water exercise that is known to benefit conditions such as arthritis. The current art does not adequately address providing an article of clothing which would improve ease of dressing independently for a disabled or physically challenged person.

In one example, when pulling a swimsuit on and off, a typical one-piece women's swimsuit may be problematic, for example, for older women who wish to participate in water aerobics or water exercise. For example, women with arthritis often have joint pain and strength and balance problems that make it very difficult to put on a stylish, form-fitting suit. Pulling off a wet suit is even harder, and requires twisting of the spine, wrists, and knees.

There is therefore a need for an article of clothing which is easier for a physically challenged person to clothe themselves with, i.e., put on and take off without assistance. It would be desirable to provide an article of clothing that does not include attachment elements, such as zippers, snaps, Velcro®, buttons, or other devices that require strength or dexterity of a person. There is also a need for the aforementioned article of clothing to be comparatively simple to manufacture.

SUMMARY OF THE INVENTION

In an aspect of the invention, an article of clothing includes a plurality of pieces of clothing. Each of the plurality of pieces of clothing includes a top strap and a bottom leg portion which are substantially opposite one another for engaging with an opposite shoulder and leg of a person, respectively.

Each of the plurality of pieces of clothing includes a body portion, and each of the body portions includes a crotch portion. Each of the body portions includes two leg openings defined by the crotch portions and respective side sections. The body portions of each of the plurality of pieces of clothing are in overlapping relation with each other to at least partially cover a person.

BRIEF DESCRIPTION OF THE DRAWINGS

These and other objects, features and advantages of the present invention will become apparent from the following detailed description of illustrative embodiments thereof, which is to be read in connection with the accompanying drawings, in which:

FIG. 4 is a front view of the left side piece of clothing which is part of the article of clothing shown in FIG. 1;

FIG. 5 is a rear view of the left side piece of clothing shown in FIG. 4;

DETAILED DESCRIPTION OF THE INVENTION

Referring to FIGS. 1-5, a multi-piece article of clothing according to an embodiment of the invention is directed to a two-piece swimwear article of clothing 10. The swimwear may be comprised of one or more of the following multi-axis stretch materials, such as: Spandex, Nylon, Polyester, and Lycra®. Other materials which are UV rated and/or chlorine resistant may include, for example, polyester PBT, Chloroban™ and Aquamax®. The swimwear 10 may also be considered active wear, or dancewear. The swimwear 10 provides clothing coverage of the person and is easy to put on and take off. The swimwear 10 includes two diagonally extending, mirror-image, pieces of clothing that generally circle from shoulder to opposite leg.

Figure 6:
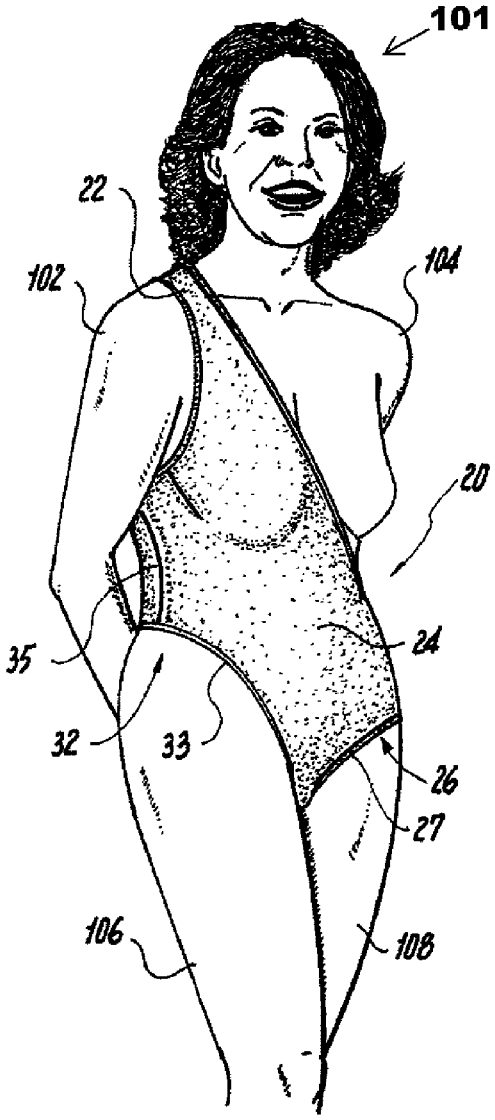
FIG. 6 is a front view of the right side piece of clothing shown in FIG. 2 being worn by a person.

The swimwear 10 includes first and second pieces of clothing corresponding to right side 20 and left side 40 pieces of clothing adapted to interact with each other, and which are arranged to cover a person's body similar to a single piece article of clothing. The right side piece of clothing 20 includes a first shoulder strap embodied as right shoulder strap 22 forming an arm hole, a first body portion embodied as a right body portion 24, and a first leg portion embodied as a left leg portion 26 having a left leg opening 27. The right shoulder strap 22 is substantially opposite the left leg portion 26. The right body portion 24 includes a right crotch portion 28. A left leg side section 30 and the right crotch portion 28 have the left leg portion 26 therebetween. The right body portion 24 includes a right hip portion 32 which has a right hip opening 33. A right hip side section 34 and the right crotch portion 28 have the right hip portion 32 therebetween. The left leg portion 26 mates with the left leg of the person such that the person passes their left leg through the left leg opening 27. The right shoulder strap 22 extends over the right shoulder of the person, as shown in FIG. 6. The right hip portion 32 mates with the right hip of the person such that the person's right leg passes through the right hip opening 33. A first soft-bra understructure to support the right breast (not shown) may be included in the right body portion 24.

Figure 7:
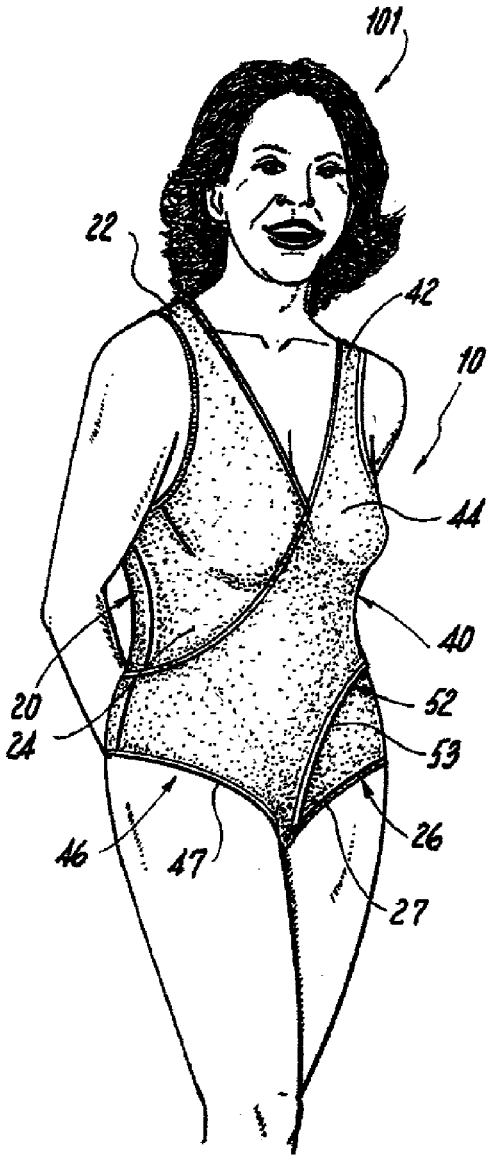
FIG. 7 is a front view of the left side piece of clothing shown in FIG. 4 being worn by the person of FIG. 6, thereby, depicting the multi-piece article of clothing shown in FIG. 1 being worn by a person.

The left side piece of clothing 40 includes a second shoulder strap embodied as left shoulder strap 42 forming an arm hole, a second body portion embodied as a left body portion 44, and a second leg portion embodied as a right leg portion 46 having a right leg opening 47. The left shoulder strap 42 is substantially opposite the right leg portion 46. The left body portion 44 includes a left crotch portion 48. A right leg side section 50 and the left crotch portion 48 have the right leg portion 46 therebetween. The left body portion 44 includes a left hip portion 52 which has a left hip opening 53. A left hip side section 54 and the left crotch portion 48 have the left hip portion 52 therebetween. The right leg portion 46 mates with the right leg of the person such that the person passes their right leg through the right leg opening 47. The left shoulder strap 42 extends over the left shoulder of the person, as shown in FIG. 7. The left hip portion 52 mates with the left hip of the person such that the person's left leg passes through the left hip opening 53. A second soft-bra, understructure to support the left breast (not shown) may also be included in the left body portion 44.

In other embodiments of the invention, the right and left shoulder straps 22, 42 may also be embodiments of top straps of a plurality of pieces of clothing. Also, the left and right leg portions 26, 46 may be embodiments of bottom leg portions of the plurality of pieces of clothing. Similarly, the right and left body portions 24, 44 may be embodiments of body portions of the plurality of pieces of clothing.

The right and left leg portions and respective openings may include elasticized edges, for example, to circle the thigh of the person. The leg opening may be generally concave in the front over the thigh, and generally convex in the back to fit under the buttocks. Similarly, the right and left hip portions may also include elasticized edges.

Figure 2:
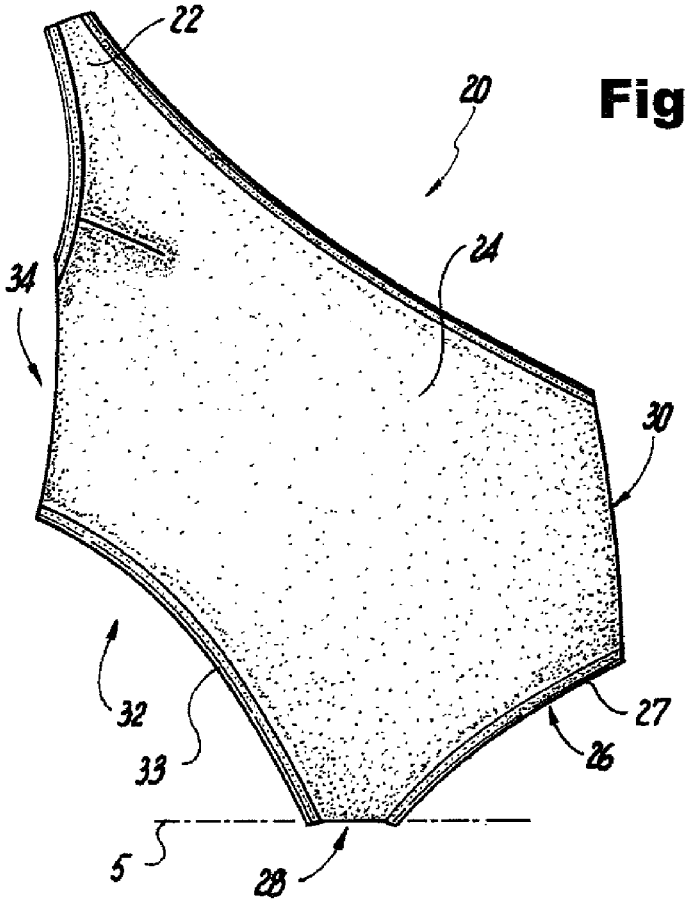
FIG. 2 is a front view of the right side piece of clothing which is part of the article of clothing shown in FIG. 1.
Figure 3:
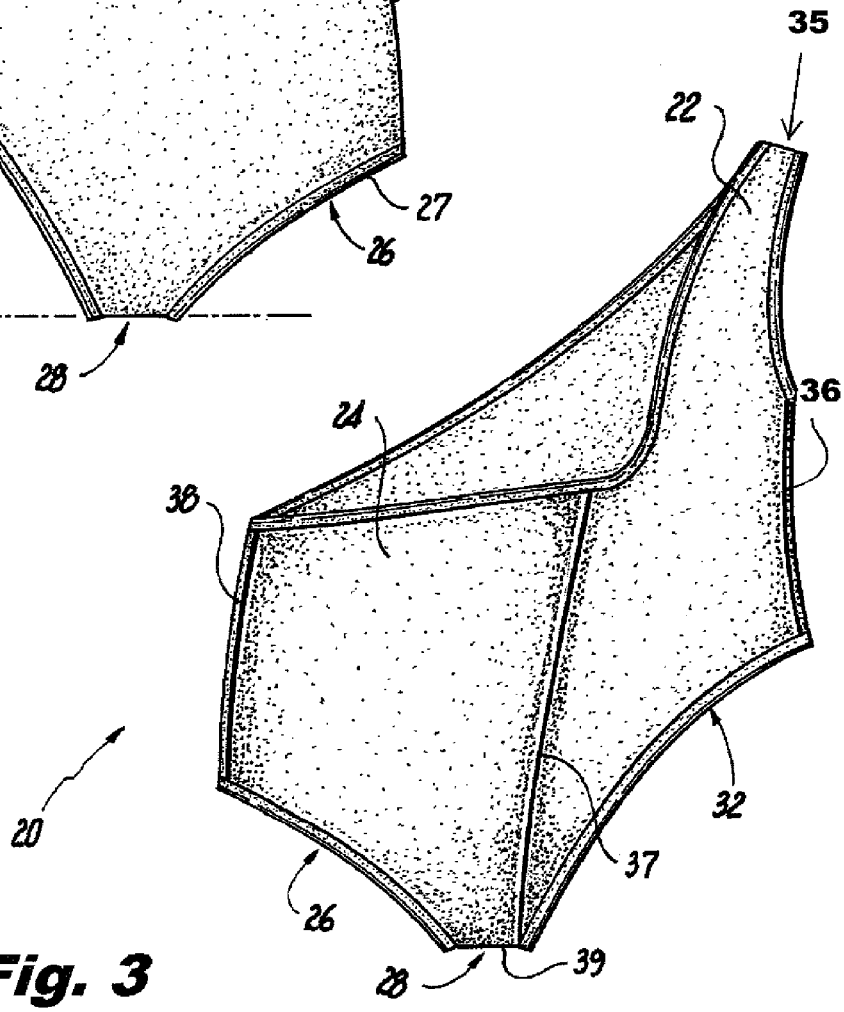
FIG. 3 is a rear view of the right side piece of clothing shown in FIG. 2.

More specifically, in an embodiment of the invention, on the right side piece of clothing 20, the right shoulder strap 22 extends over the right shoulder of the person, as shown in FIGS. 2, 3, and 6, and is attached with a horizontal seam 35 at the top of the shoulder to the back of the right body portion 24. A right shoulder side seam 36 (which is an embodiment of a shoulder side seam) connects the right side of the right body portion 24 to the back of the body portion 24 extending vertically so that the bottom of the seam rests on the right hip opening 33. A single middle seam 37 (as an embodiment of a middle seam) runs vertically down the middle of the back of the right body portion (and down the back of a person) to meet a single horizontal crotch seam 39 (which is an embodiment of an individual crotch seam) at a back of the crotch portion 28, for ease of cutting and assembly in manufacture. Generally, right shoulder side seam 36 is opposite a side seam 38 (which is an embodiment of an individual side seam), wherein side seam 38 runs vertically from below a natural waist area to a beginning (top) of the left leg opening 27 and connects the left side of the right body portion 24 to the back of body portion 24 ending at the left leg portion 26. Similar construction is applied to the left side piece of clothing 40 and body portion 44.

Figure 1:
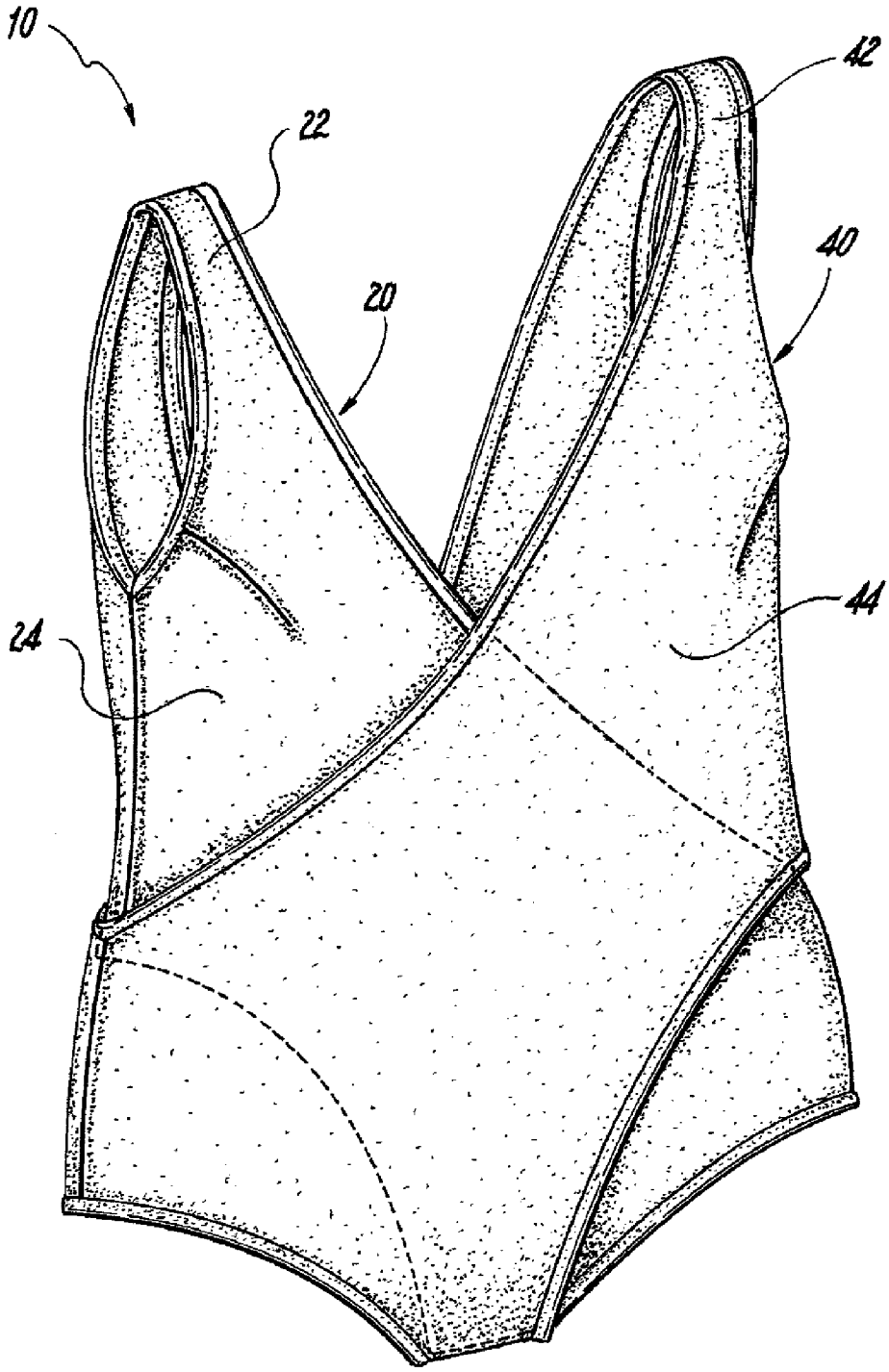
FIG. 1 is an isometric view of a multi-piece article of clothing according to an embodiment of the invention including a right side piece and a left side piece.

Thereby, the right and left body portions 24, 44 are in overlapping relation to each other, or one inside the other, when the right and left side pieces of clothing 20, 40 are assembled as shown in FIG. 1, and worn as shown in FIG. 7. Further, the right and left body portions 24, 44, the right and left crotch portions 28, 48, and right and left leg portions 26, 46 of the right and left side pieces of clothing 20, 40 at least partially cover the chest, front and back midsection or central body area or torso, and groin area of the person's body.

The independence of the right side and left side pieces of clothing 20, 40 provides unusual ease of movement. Each piece 20, 40 is cut high in the hip on its shoulder side, and low across the back on the leg portion side to make it easy to pull on or off, while maintaining the position of the crotch portion, respectively. When the second piece of clothing is put on, its leg opening covers the hip portion of the first piece and thereby the exposed hip of the person, creating the appearance of a traditional one-piece swim suit with two regular leg openings. Similarly, each piece interacts diagonally in the back to partially cover the exposed lower back of the person.

Referring to FIGS. 6-7, a method of using the multi-piece article of clothing according to the present invention includes a person 101 passing either their right or left leg through a corresponding leg portion 26, 46. In FIG. 6, the person's 101 left leg 108 engages the left leg portion 26 and is passed through the left leg opening 27 of the right side piece of clothing 20. The right shoulder strap 22 is over the person's 101 right shoulder 102. The person's right hip and right leg engage the right hip portion 32 and their right leg 106 passes through the right hip opening 33.

Referring to FIG. 7, the person's 101 right leg 106 is passed through the right leg portion 46 of the left side piece of clothing 40. The left shoulder strap 42 is over the person's 101 left shoulder 104. The person's left hip and left leg engage the left hip portion 52 and their left leg 108 passes through the left hip opening 53. The right and left side pieces of clothing 20, 40 with the body portions 24, 44 are in overlapping relation as shown in FIGS. 6 and 7 covering the front and back midsection or torso of the person 101 in a surplice style.

The above described overlapping two piece swimsuit for women provides the coverage and stability of one piece suits, which may be used for water aerobics and physical therapy in adaptive aquatics programs which may include programs for persons with disabilities such as arthritis. The hip openings provide easy access for a person's legs. For example, to put on the right side piece of clothing 20, the person inserts their left leg 108 through the left leg opening 27 and the right leg 106 through the large right hip opening 33, and then pulls the right body portion 24 up to the right shoulder 102, slipping the right arm through the right shoulder strap 22. Since there is no opposing upper left front or back body portion, or left shoulder strap in the right side piece of clothing 20 to create drag or friction when the right side piece of clothing 20 is pulled up, it is easy for the person to slide the right shoulder strap 22 over the right shoulder 102. In addition, the large size of the right hip opening and the absence of upper left side structure or fabric significantly reduces the amount of fabric the person must pull up in order to put on the right side piece of clothing 20, or pull down in order to take off the right side piece of clothing 20, thus resulting in ease of clothing oneself. Similarly, the left side piece of clothing 40 can be applied. Thereby, the present invention as in the above described embodiment provides a multi-piece unitary article of clothing, e.g., a swimsuit.

Referring to FIG. 7, the person's body is well covered when both the right side piece of clothing 20 and the left side piece of clothing 40 are worn together, one on top of the other. The right and left body portions 24, 44 cover the chest area, and may include soft-bra, one-breast understructures (not shown), and cover the front and back torso and midsection of the person. The groin area is covered by the right and left crotch portions 28, 48. The left and right leg portions 26, 46 cover the right and left hip openings 33, 53, respectively, with the lower margins of the leg openings being equivalent to the traditional one-piece swimsuit.

Referring to FIG. 7, the overlapping two piece article of clothing comprised of the right side piece 20 and the left side piece 40 worn together does not need to be secured with attachments, buttons, zippers, VELCRO® or other means. The tension in the multi-axis fabric and in the elastic sewn into the rolled edges, especially along the margins of the right side body portion 24 and the left side body portion 44, keep the combined surplice suit in place. The tension in the fabric and margin elastic is most pronounced running from the shoulder in front to the opposite leg, and from the hip to the crotch in both the right and left side pieces of clothing. This tension keeps the suit from riding up or twisting or opening during water exercise. The independence of the two pieces of clothing, first and second pieces of clothing 20, 40, and lack of a defined waist area (e.g., waist band or elastic waist band), enables the two pieces of clothing to easily slide as the person moves.

Referring to the embodiment of the invention shown in FIGS. 1 and 2, the left leg opening 27 and the right hip opening 33 extend at acute angles, respectively, from a horizontal axis 5 defined by a bottom section of the right crotch portion 28, of the right side piece of clothing 20 and likewise for the left side piece of clothing 40. Further, the left leg opening 27 extends at a first leg acute angle which is less than a first hip acute angle defined by the first hip opening, and likewise for the left side piece of clothing 40. The circumference of each hip opening is approximately twice the circumference of each leg opening.

The present invention may include other embodiments of clothing, for example, activewear, hospital wear, shapewear, and lingerie, and modifications such as sleeves, pant legs and crotch piece that can be opened. The present invention thereby allows a person who has limitations of strength and balance to clothe themselves, e.g., put on, and take off a form-fitting swimsuit without assistance. Further, the present invention provides an article of clothing without the use of attachment devices, such as, zippers, snaps, Velcro®, buttons, or other attachments that require strength or dexterity to manipulate.

While the present invention has been particularly shown and described with respect to a preferred embodiment thereof, it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. An article of clothing, comprising:

a plurality of pieces of clothing including a first and a second piece of clothing;

each of the plurality of pieces of clothing including a single shoulder strap and a bottom leg portion being substantially opposite one another for engaging with an opposite shoulder and leg of a person, respectively;

each of the plurality of pieces of clothing including a body portion extending between and connecting the single shoulder strap and the bottom leg portion ;

each of the body portions including a crotch portion; and each of the body portions including two leg openings defined by the crotch portions and respective side sections, the body portion of each of the plurality of pieces of clothing being in overlapping relation with each other to at least partially cover the person and wherein the body portion and the bottom leg portion of each of the plurality of pieces of clothing at least partially cover a chest, front and back midsection, and groin area of the person's body.

2. The article of clothing of claim 1, wherein the crotch portions overlap.

3. The article of clothing of claim 1, wherein the plurality of pieces of clothing fit one inside the other.

4. A multi-piece article of clothing, comprising:

a first piece of clothing including a first shoulder strap, a first body portion, and a first leg portion defining a first leg opening, the first leg portion being substantially opposite the first shoulder strap, the first leg portion being engageable with a first leg of a person being on an opposite side of the person's body of a first shoulder of the person;

the first body portion including a first crotch portion, the first crotch portion and a first leg side section having the first leg opening therebetween;

the first body portion including a first hip portion defining a first hip opening for passing a second leg of the person therethrough, the first crotch portion and a first hip side section having the first hip opening therebetween;

a second piece of clothing including a second shoulder strap, a second body portion, and a second leg portion defining a second leg opening, the second leg portion being engageable with the second leg of a person being opposite a second shoulder of the person;

the second body portion including a second crotch portion, the second crotch portion and a second leg side section having the second leg opening therebetween;

the second body portion including a second hip portion defining a second hip opening for passing the first leg of the person therethrough, the second crotch portion and a second hip side section having the second hip opening therebetween; and the first piece of clothing and the second piece of clothing each including only a single shoulder strap;

the first and second body portions being in overlapping relation when worn by a person;

wherein the first and second body portions, the first and second crotch portions, and the first and second leg portions, at least partially cover a chest, front and back midsections, and groin area of the person's body.

5. The article of clothing of claim 4, wherein the crotch portions overlap.

6. The article of clothing of claim 4, wherein the first and second pieces of clothing fit one inside the other.

7. The article of clothing of claim 4, wherein the first shoulder strap being a right shoulder strap engageable with a right shoulder of the person, the first leg portion being a left leg portion engageable with a left leg of the person, the first leg side section being a left leg side section, the first hip portion being a right hip portion engageable with the right hip of the person, the first hip side section being a right hip side section, and the second shoulder strap being a left shoulder strap engageable with a left shoulder of the person, the second leg portion being a right leg portion engageable with a right leg, the second leg side section being a right leg side section, the second hip portion being a left hip portion engageable with the left hip of the person, the second hip side section being a left hip side section.

8. The article of clothing of claim 4, wherein the first leg opening and the first hip opening extend at first leg opening and first hip opening acute angles, respectively, from a horizontal axis defined by a bottom section of the first crotch portion;

wherein the second leg opening and the second hip opening extend at second leg opening and second hip opening acute angles, respectively, from a horizontal axis defined by a bottom section of the second crotch portion.

9. The article of clothing of claim 8, wherein the first leg opening extends at a first leg acute angle and the first hip opening extends at a first hip acute angle, and the first hip acute angle is larger than the first leg acute angle; and the second leg opening extends at a second leg acute angle and the second hip opening extends at a second hip acute angle, and the second hip acute angle is larger than the second leg acute angle.

10. The article of clothing of claim 4, further comprising:

individual crotch seams extending horizontally across both the first and second crotch portions.

11. The article of clothing of claim 4, further comprising:

individual middle seams extending vertically from a top middle area of a back of each of the first and second body portions to meet a horizontal seam of the first and second crotch portions, respectively.

12. A method of manufacturing a multi-piece article of clothing, comprising:

forming a first shoulder strap, a first body portion, and a first leg portion defining a first leg opening in a first piece of clothing, the first leg portion being substantially opposite the first shoulder strap, the first leg portion being engageable with a first leg of a person being on an opposite side of the person's body of a first shoulder of the person;

forming a first crotch portion in the first body portion, the first crotch portion and a first leg side section having the first leg opening therebetween;

forming a first hip portion in the first body portion, the first hip portion defining a first hip opening for passing a second leg of the person therethrough;

positioning the first crotch portion and a first hip side section with the first hip opening therebetween;

forming a second shoulder strap, a second body portion, and a second leg portion defining a second leg opening in a second piece of clothing, the second leg portion being engageable with the second leg of a person being opposite a second shoulder of the person;

forming a second crotch portion in the second body portion, the second crotch portion and a second leg side section having the second leg opening therebetween;

forming a second hip portion in the second body portion, the second hip portion defining a second hip opening for passing the first leg of the person therethrough; and positioning the second crotch portion and a second hip side section with the second hip opening therebetween, and the first and second body portions being positionable in overlapping relation;

wherein when formed, the first piece of clothing and the second piece of clothing each including only a single shoulder strap;

when the article of clothing is worn by the person, the first and second body portions, the first and second crotch portions, and the first and second leg portions, at least partially cover a chest, front and back midsections, and groin area of the person's body.

13. The method of claim 12, further comprising:

positioning the first and second body portions in overlapping relation, wherein the crotch portions overlap.

14. The method of claim 12, the first shoulder strap being a right shoulder strap engageable with a right shoulder of the person, the first leg portion being a left leg portion engageable with a left leg of the person, the first leg side section being a left leg side section, the first hip portion being a right hip portion engageable with the right hip of the person, the first hip side section being a right hip side section, and the second shoulder strap being a left shoulder strap engageable with a left shoulder of the person, the second leg portion being a right leg portion engageable with a right leg, the second leg side section being a right leg side section, the second hip portion being a left hip portion engageable with the left hip of the person, the second hip side section being a left hip side section.

15. The method of claim 12, further comprising:

extending the first leg opening and the first hip opening at first leg opening and first hip opening acute angles, respectively, from a horizontal axis defined by a bottom section of the first crotch portion; and extending the second leg opening and the second hip opening at second leg opening and second hip opening acute angles, respectively, from a horizontal axis defined by a bottom section of the second crotch portion.

16. The method of claim 12, further comprising:

extending the first leg opening at a first leg acute angle;

extending the first hip opening at a first hip acute angle, wherein the first hip acute angle is larger than the first leg acute angle;

extending the second leg opening at a second leg acute angle; and extending the second hip opening at a second hip acute angle, wherein the second hip acute angle is larger than the second leg acute angle.

17. The method of claim 12, further comprising:

extending individual crotch seams horizontally across both the first and second crotch portions;

extending individual side seams vertically from below a natural waist area of both the first and second body portions to a beginning of both the first and second leg openings, respectively; and extending individual shoulder side seams vertically from a shoulder arm hole area of both the first and second body portions to a beginning of both the first and second hip openings, respectively.

18. The method of claim 12, further comprising:

extending individual middle seams vertically from a top middle area of a back of each of the first and second body portions to the first and second crotch portions, respectively.

* * * * *